United States Patent [19]

De Franco

[11] 4,275,828

[45] Jun. 30, 1981

[54] DISPENSING BOX CONSTRUCTION

[75] Inventor: Samuel M. De Franco, El Cerrito, Calif.

[73] Assignee: Willamette Industries, Inc., San Leandro, Calif.

[21] Appl. No.: 66,178

[22] Filed: Aug. 13, 1979

[51] Int. Cl.[3] ..... B65D 5/32; B65D 5/48

[52] U.S. Cl. ..... 229/23 R

[58] Field of Search ..... 229/23 R

[56] References Cited

U.S. PATENT DOCUMENTS

| | | | |
|---|---|---|---|
| 2,606,709 | 8/1952 | Carey et al. | 229/23 R |
| 3,428,234 | 2/1969 | Du Barry, Jr. | 229/23 R |
| 3,434,648 | 3/1969 | Du Barry, Jr. | 229/23 R |
| 3,850,362 | 11/1974 | Stollberg et al. | 229/34 R X |
| 4,050,623 | 9/1977 | Vacchi | 229/23 R |
| 4,133,474 | 1/1979 | Hall | 229/23 R |
| 4,194,678 | 3/1980 | Jasper | 229/23 R |

*Primary Examiner*—Davis T. Moorhead

[57] ABSTRACT

An improved box construction is provided which is characterized by having great stacking strength and, at the same time, is readily opened for removal of a product contained in the box.

3 Claims, 17 Drawing Figures

DISPENSING BOX CONSTRUCTION

BACKGROUND OF THE INVENTION

The necessity that containers suited for multiple stacking have good corner column strength has been recognized heretofore and one can refer to the Props U.S. Pat. No. 2,540,595 of Feb. 6, 1951 and to the Guyer U.S. Pat. No. 2,885,137 of May 5, 1959 for a box construction having value in this regard. The Guyer container, however, is assembled and the several elements are secured by rivets. I have found that a material and substantial improvement can be provided over the Props and Guyer structures if, instead of using rivets, the several box elements are secured together with glue. Gluing of some box elements, however, has heretofore been proposed in the Dornbush et al U.S. Pat. No. 3,275,217 of Sept. 27, 1966 wherein a separate inner collar is provided in an outer box structure.

SUMMARY OF THE INVENTION

It is in general the broad object of the present invention to provide a new improved box construction, particularly one having improved stacking strength and at the same time can be readily opened for dispensing of the commodities packed in the container.

DESCRIPTION OF THE PREFERRED EMBODIMENT

Figure 5:
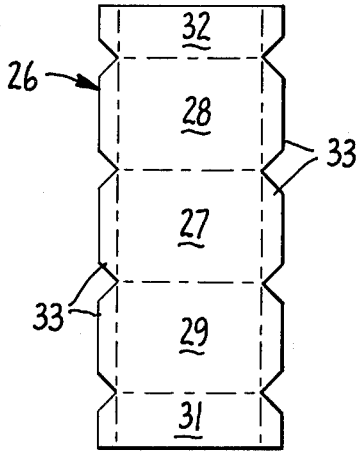
FIG. 5 is a plan view of the blank used to provide the top closure for the container.
Figure 6:
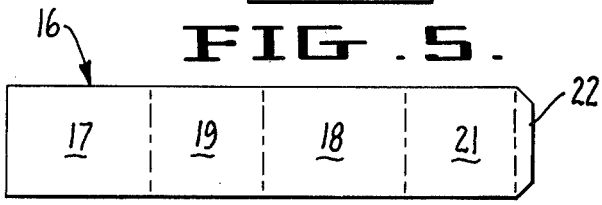
FIG. 6 is a plan view of the side wall portion of the container.
Figure 7:
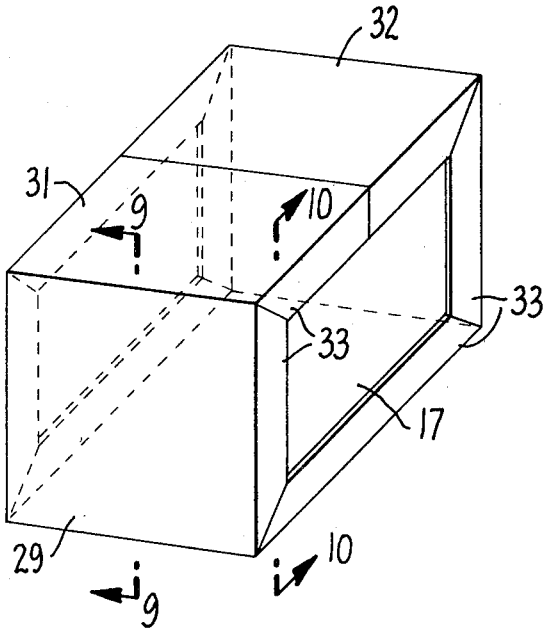
FIG. 7 is a perspective view of another form of the assembled container.
Figure 11:
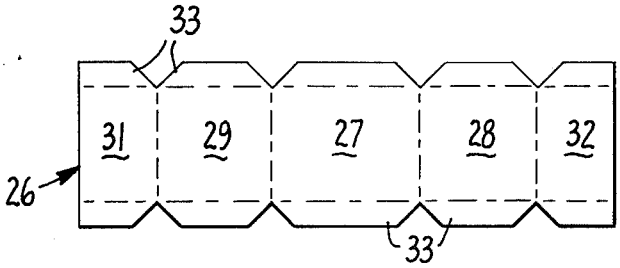
FIG. 11 is a plan view of the element providing the containment portion of the container.
Figure 12:
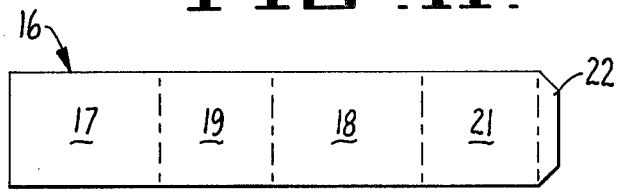
FIG. 12 is a plan view of the side wall portion.
Figure 13:
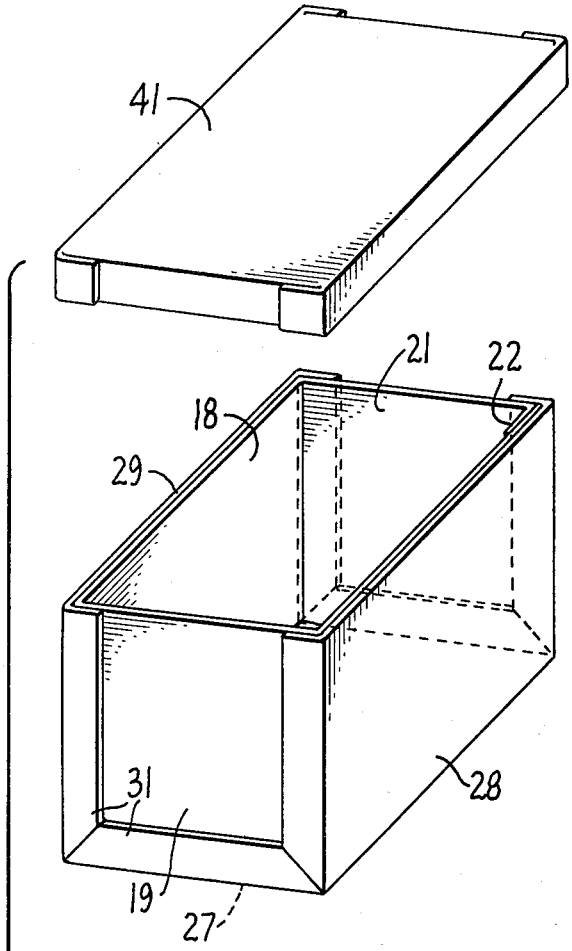
FIG. 13 is a perspective view showing a modified form of box construction embodying the present invention.
Figure 14:
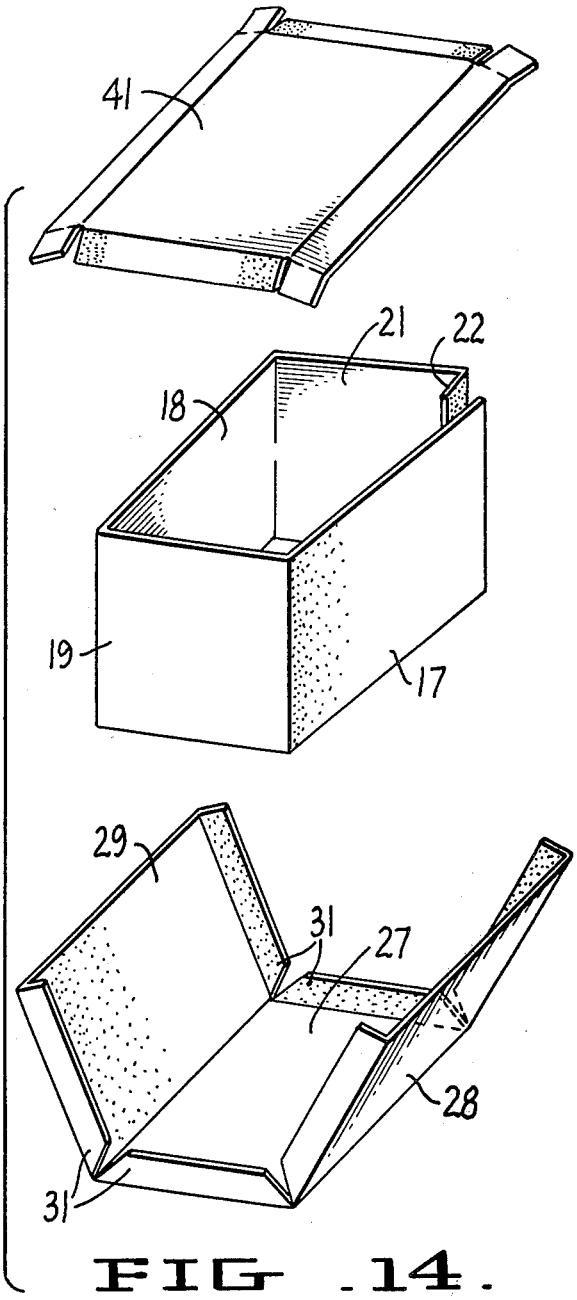
FIG. 14 is an exploded view showing the several components of a box prior to assembly.
Figure 15:
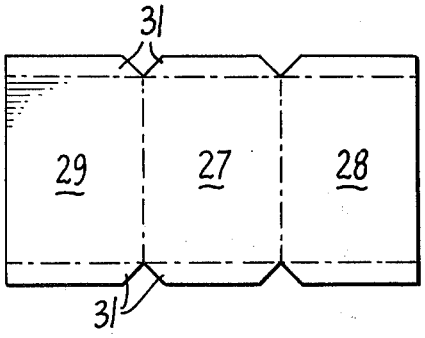
FIGS. 15 and 16 are each plan views of a portion of the containment section employed in a box shown in FIGS. 13 and 14.
Figure 17:
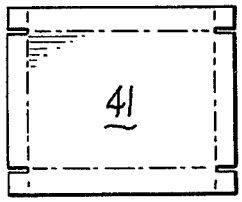
FIG. 17 is a plan view of a top or cover element.
Figure 16:
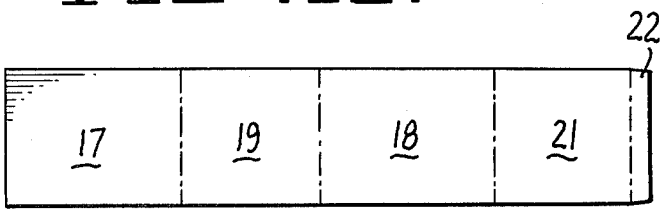

Referring particularly to FIGS. 6 and 12 in the drawings, the side wall and end portion of the container provided by the blanks, generally indicated at 16, having opposite side walls 17 and 18 and end walls 19 and 21. The end wall 21 has an extending tab 22 adapted to be secured with a suitable adhesive such as a glue to the opposite cooperating end of side wall 17. The containment portion of the container is provided by the blank 26 illustrated in FIGS. 5 and 11. The blank 26 includes a bottom 27, side walls 28 and 29 and top portions 31 and 32. Each of the elements in blank 26 includes side tabs 33.

Figure 1:
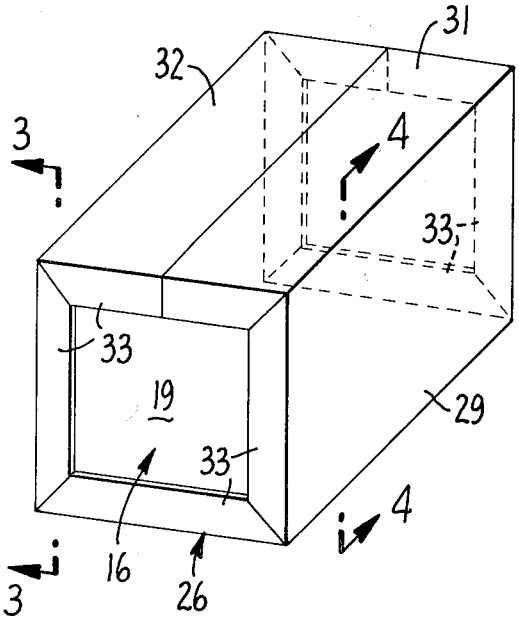
FIG. 1 is a perspective view of the assembled container.
Figure 2:
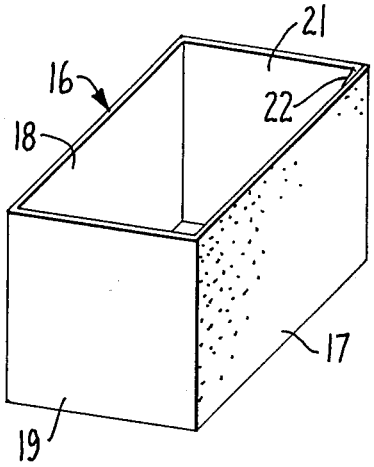
FIG. 2 is an exploded view showing the top portion of the container in an open position to receive a containment unit.
Figure 2:
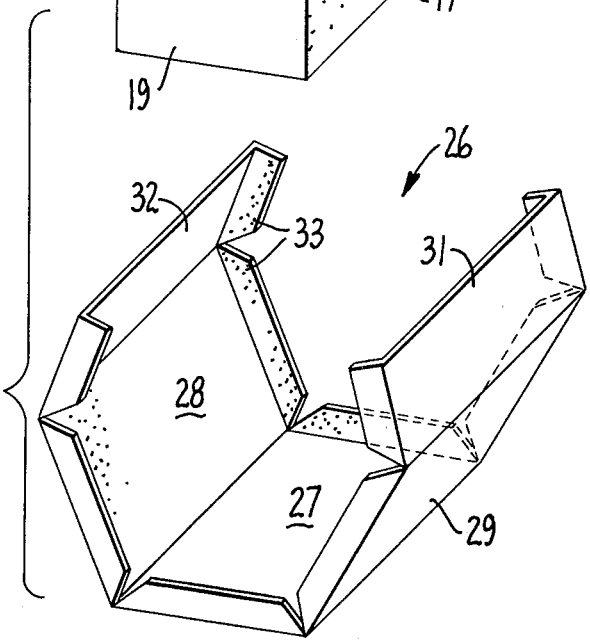
Figure 3:
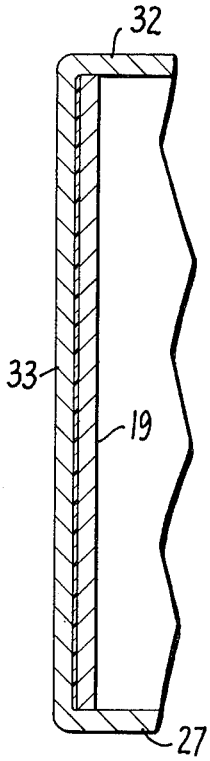
FIGS. 3 and 4 are, respectively, views taken along the section lines 3—3 and 4—4 in FIG. 1.
Figure 4:
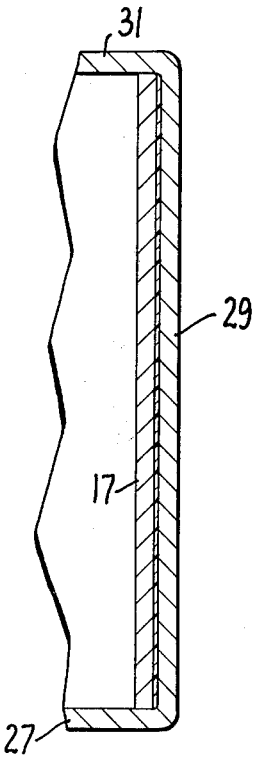
Figure 8:
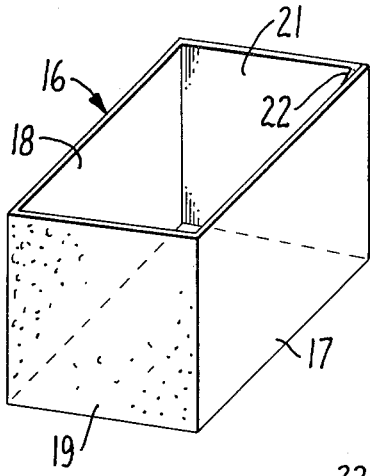
FIG. 8 is a perspective view in exploded form showing the elements going to make up the container of FIG. 7.
Figure 8:
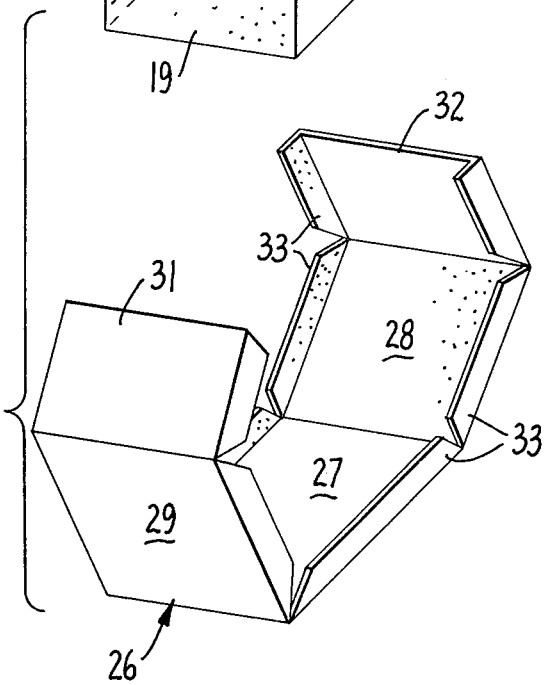
Figure 9:
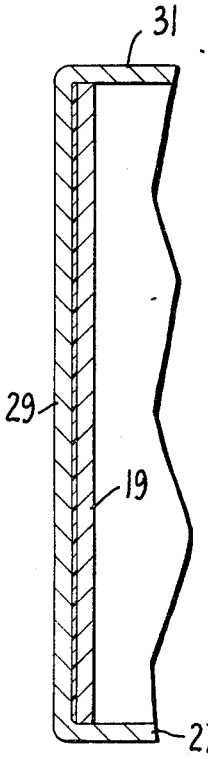
FIGS. 9 and 10 are sections taken along the lines 9—9 and 10—10 in FIG. 7.
Figure 10:
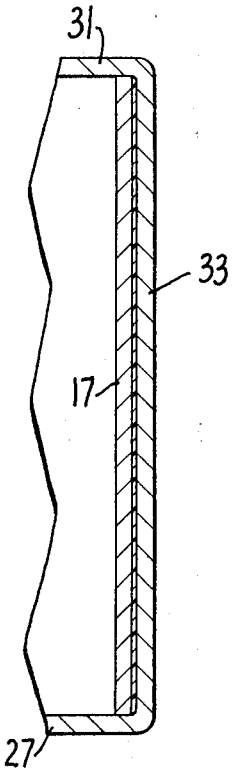

In use, the blank 16 is assembled into the form shown in the upper portion of FIGS. 2 and 8 providing, in effect, an open tube. The containment portion is then assembled about the open tube, the tabs 33 being secured by a suitable adhesive to the corresponding elements of the open tube container. When it is desired to open the container, it is merely necessary to release the top portions 31 and 32 but the container otherwise remains intact and in position around the open tube container.

The tabs 33 and side walls 28 and 29 are secured by an adhesive to the corresponding elements in the open ended tube. That is in the case of the structure shown in FIGS. 1 through 6, elements 28 and 29 are adhesively secured to elements 17 and 18 of the open tube, while in the structure shown in FIGS. 7 through 12, elements 29 and 28 are secured to elements 19 and 21. This securing of the abutting elements with an adhesive provides increased column strength. Further, upon release of the top elements 31 and 32, the contents of the container can be readily observed.

The two forms of the container of this invention so far discussed are much alike. The difference between them is in the direction of wrapping of the outer containment about the open ended tube. In that form shown in FIGS. 1 through 6, the wrapping is effected about the bottom and side walls of the tube, while in that form shown in FIGS. 7 through 12, the wrapping is about the bottom and the end walls. In each case, the top portions overlap the open end of the tube to seal the contents within the tube. In that form of the invention shown in FIGS. 13 through 17, the top elements 31 and 32 have been omitted and replaced by a separate removable top 41. This permits the contents of the box to be readily exhibited, a feature of advantage in the marking of such fruit as apples.

I claim:

1. A box comprising:

a unitary, integral tube which includes a first rectangular side wall panel having first and second end edges, a first end wall panel having first and second end edges with said first end edge of said first side wall panel being foldably and integrally connected to said first end edge of said first end wall panel, a second side wall panel having first and second end edges with a first end edge of said second side wall panel being foldably and integrally connected to said second end edge of said first end wall panel, a second end wall panel having first and second end edges with said first end edge of said second end wall panel being foldably and integrally connected to said second end edge of said second side wall panel, and a tab foldably and integrally connected to said second end edge of said second end wall panel and being attached to said first end edge of said second side wall panel to form a rectangular tube having both ends thereof open, and a container containment portion which includes a first rectangular top panel having first and second end edges and first and second side edges, a first rectangular side wall having first and second end edges and first and second side edges with said side wall first end edge being integrally and foldably connected to said first top panel first end edge, a rectangular bottom panel having first and second end edges and first and second side edges with said bottom panel first end edge being integrally and foldably connected to said side wall second end edge, a second rectangular side wall having first and second end edges and first and second side edges with said side wall first end edge being foldably and integrally connected to said bottom second end edge, a second rectangular top panel having first and second end edges and first and second side edges with said second panel first end edge being integrally and foldably connected to said second side wall second end edge, and side tabs integrally and foldably connected to the side edges of said top panels, said side wall panels and said bottom, said side tabs covering essentially the entire length of said side edges and having mitered end edges and interfitting with each other in a miter joint fit with attaching means attaching said side tabs to said tube panels.

2. The box defined in claim 1 further including a top which includes a rectangular main panel having end edges and side edges, a rectangular side panel member foldably and integrally connected to each main panel side edge and a rectangular end panel member foldably and integrally connected to each main panel end edge, end tabs on each end of each side panel member to overlap said end panel members and be secured thereto.

3. The box defined in claim 1 wherein all of said tube panels are continuous and uninterrupted for essentially the entire area thereof.

* * * * *